United States Patent [19]

Churchill

[11] Patent Number: 4,520,935

[45] Date of Patent: Jun. 4, 1985

[54] TREE STAND

[76] Inventor: Howard Churchill, 662 Dartmouth Ave., San Carlos, Calif. 94070

[21] Appl. No.: 591,838

[22] Filed: Mar. 21, 1984

[51] Int. Cl.[3] ..... A47F 7/00

[52] U.S. Cl. ..... 211/124; 211/175; 211/208; 211/60.1

[58] Field of Search ..... 211/124, 189, 193, 162, 211/206, 175, 190, 208, 123, 86, 57.1, 182, 59.1, 60 R, 60 T, 60 SK; 248/163, 165, 121, 316.5, 316.7, 519, 529; 47/40.5, 47

[56] References Cited

U.S. PATENT DOCUMENTS

| | | | |
|---|---|---|---|
| 715,530 | 12/1902 | Wallace | 211/206 X |
| 933,650 | 9/1909 | Kramer | 211/206 X |
| 1,306,297 | 6/1919 | Auerochs | 211/59.1 X |
| 1,663,176 | 3/1928 | Reyer | 211/124 |
| 1,790,798 | 2/1931 | Davis | 211/182 |
| 2,456,622 | 12/1948 | Clark | 211/124 X |
| 2,849,202 | 8/1958 | McCombs | 248/188.5 X |
| 3,338,422 | 8/1967 | Hickok | 211/60 SK |
| 3,363,340 | 1/1968 | McKinley | 211/182 X |
| 3,519,140 | 7/1970 | Wellman | 211/182 X |

FOREIGN PATENT DOCUMENTS

| | | | |
|---|---|---|---|
| 131129 | 1/1949 | Australia | 211/124 |
| 1161301 | 8/1969 | United Kingdom | 211/60 T |

*Primary Examiner*—Robert W. Gibson, Jr.

*Attorney, Agent, or Firm*—Fliesler, Dubb, Meyer & Lovejoy

[57] ABSTRACT

A stand (10) for displaying one or more trees comprises towers (12, 14, 16) supporting a channel (28) and a device (50, 52) for securing the trees to the stand (10). The tree securing device (50, 52), including a base (54, 88) which is slidably positionable in the channel (28), a clip (58, 104) for allowing the tree to be secured to the securing device (50, 52) and an extension (56, 102) for securing the clip (58, 104) to the base (54, 88). The securing device (50, 52) can be disposed in a manner which is substantially perpendicular to the channel (28) for displaying trees along the length of the channel (28) and can also be disposed at the ends of the channel (28) for displaying a tree at each end of the channel (28).

13 Claims, 4 Drawing Figures

FIG.—1
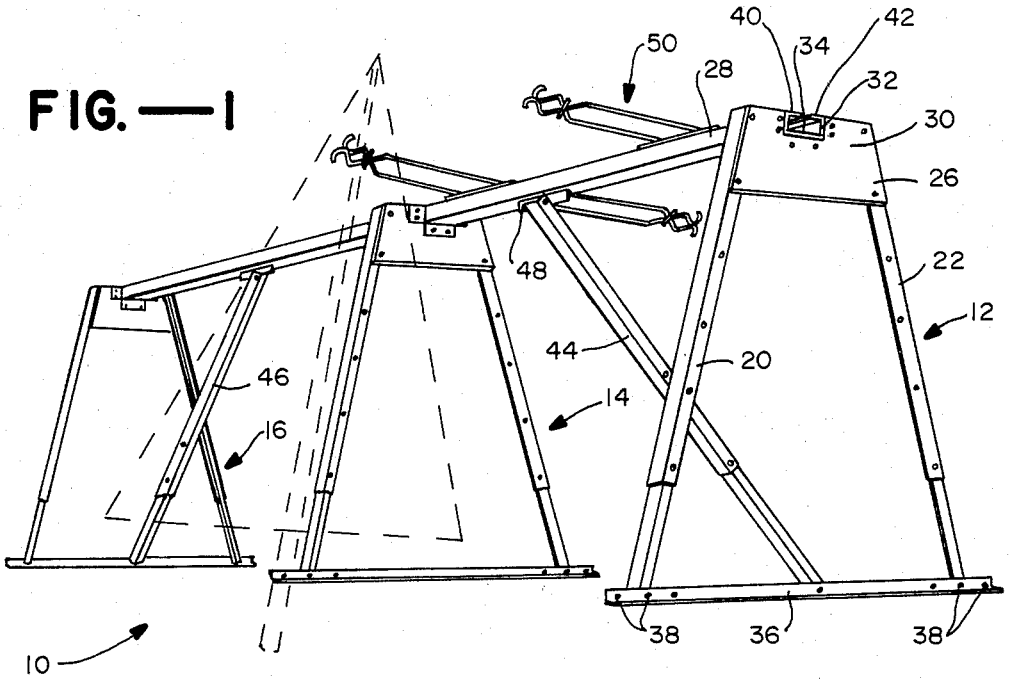
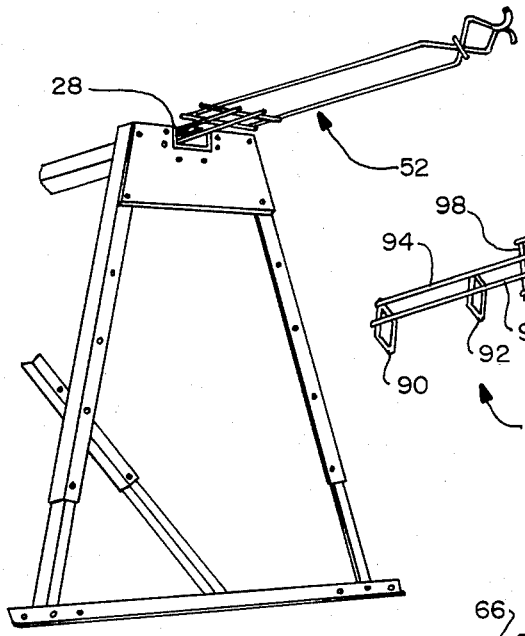
FIG.—2
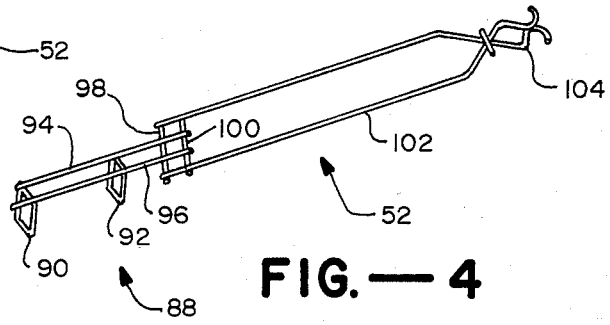
FIG.—4
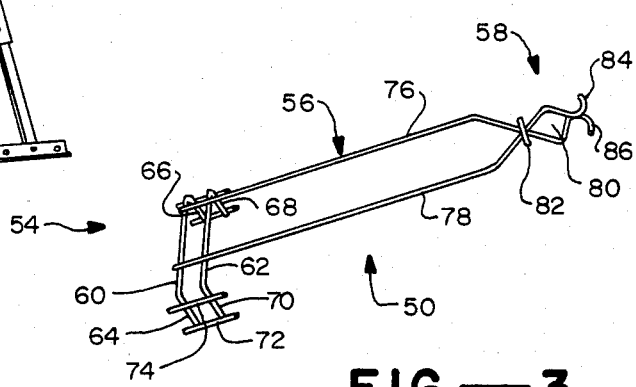
FIG.—3

TREE STAND

FIELD OF THE INVENTION

The present invention is directed to a structure for displaying objects, and in particular, to a structure for displaying trees, such as Christmas trees.

BACKGROUND ART

A variety of methods are presently employed in order to be able to display freshly cut trees in tree lots. One method is to attach a wooden base to the tree. This is not entirely satisfactory, as trees tend to act as a sail in the presence of a wind, and thus are susceptible to being toppled over by such a wind. Other stands which may be used in combination with the above base are comprised of essentially fences which can be built of either rigid members which form the uprights and cross members or rigid members which form the uprights with flexible wires forming the cross members. In either case, the tree to be displayed is tied or secured to the cross members by appropriate fasteners. Such stands, while having distinct advantages over the use of merely a base with the tree, tend not to be customer-proof. To inspect a tree, a customer unsecures the tree from the stand. However, the tree often winds up lying on the ground as the customer will not make the effort to resecure the tree to the stand. Also, in the case of the wire cross member, the trees tend to slide into the middle, especially when there is a wind, and thus are not properly displayed.

Accordingly there is a need to provide a tree stand which will display a plurality of trees in an organized and attractive manner and which will withstand the wind and be, as far as possible, customer-proof.

The present invention is directed to overcoming the above disadvantages noted with respect to the prior art.

SUMMARY OF THE INVENTION

In one aspect of the invention, a stand for displaying one or more trees comprises a first support tower, a second support tower, a channel, first means for allowing the first support tower to support the channel at one location on the channel and second means for allowing the second support tower to support the channel at another location on the channel. The stand further includes means for securing a tree to the stand, said securing means including a base means holding said securing means in said channel, clip means for allowing the tree to be secured to said securing means and extension means for connecting the base means to the clip means, the base means being slidably positioned in the channel.

In another aspect of the invention, the stand includes a plurality of securing means which are slidably positioned in the channel.

In still a further aspect of the invention, the extension means is disposed substantially perpendicular to the channel with the base means disposed in the channel.

In yet another aspect of the invention, the extension means is disposed substantially parallel to the channel with said base means disposed in the channel. In this aspect of the invention, the securing means extends from the edge of the channel.

In yet another aspect of the invention, the support towers include first and second telescoping legs secured to the means for allowing the support tower to support the channel, and wherein the ends of the first and second telescopings legs are selectively secured to a cross member base at locations depending on the degree of telescoping of said first and second legs.

In another aspect of the invention, the clip means define a capture area for holding the tree.

From the above it can be seen that the present invention provides for a stand which will display a plurality of trees in a pleasing manner and in a spaced arrangement. The stand of the invention is rigid and can withstand the tendency of the wind to push the trees over. Further, due to the clip means, the trees can be easily removed from the stand by a customer, for inspection purposes, and then easily repositioned by the customer.

BRIEF DESCRIPTION OF THE FIGURES

FIG. 1 is a perspective view of an embodiment of the stand with one type of securing device extending therefrom.

FIG. 2 is a partial perspective view of the embodiment of FIG. 1 with a different type of securing device extending therefrom.

FIG. 3 is a perspective view of the securing device shown in FIG. 1.

FIG. 4 is a perspective view of the securing device shown in FIG. 2.

DETAILED DESCRIPTION OF THE PREFERRED EMBODIMENT

With respect to the figures, and in particular to FIG. 1, the stand of the invention is depicted and denoted by the numeral 10. Stand 10 includes first, second and third support towers 12, 14, 16. Each support tower includes telescoping legs such as legs 18 and 20 of the first support tower 12. These legs can be extended as required, depending on the height of the tree to be displayed. Further, it is to be understood that each of the telescoping legs includes two members such as members 22 and 24 of leg 18 and that each of these members is of a different length. Thus in construction of stand 10, it is possible to use one or the other of these members, should the tree be of a height that telescoping is not required.

Each of the support towers includes a means 26 for allowing a support tower to support a channel 28 at a location along the channel. This means 26 includes substantially a plate structure 30 to which are secured the first and second telescoping legs 20 and 22 to form a substantially A-shaped support tower 12. The channel 28 can be bolted to the plate structure 30, with flanges and the like which are well known in the art, and be aligned with an aperture 32 formed in plate structure 30 to allow access to the interior of the channel 28.

Located at the distal ends of the first and second legs 18 and 20 of support tower 12 is a cross member base 36 which is secured to the legs. A number of apertures 38 are located along the cross member base 36 to allow the first and second legs 18 and 20 to be secured to the base 36 at various locations, depending on the degree of extension of the telescoping legs 18, 20. The cross member base 36 can be secured to the ground with appropriate stakes which may be provided through additional apertures in the base 36.

The channel 28 is substantially U-shaped in cross section, and includes lips 40 and 42 which will be used as disclosed hereinbelow for retention purposes. The channel 28 can be of any desired length. As shown in the embodiment in FIG. 1, the channel is long enough so that three supporting towers are required to support the channel and the weight associated with the trees affixed thereto. However it is to be understood that shorter channels with two supporting towers and longer channels with four supporting towers and more can be made and fall within the scope of the present invention.

In the embodiment of FIG. 1, telescoping cross members 44 and 46 are secured between the base, such as base 36 of the support towers, and a bracket, such as bracket 48 affixed to the channel 28, so as to give additional support to the channel.

The invention further includes means for securing a tree to the stand. This means, in the preferred embodiment, includes a first securing device 50 (FIGS. 1, 3), which allows a tree to be disposed on the side of the stand 10, and a second securing device 52 (FIGS. 2, 4), which allows the trees to be supported at the ends of the stand 10.

In FIG. 3, the first securing device 50 includes a base 54 which is slidably positionable in the channel 28, an extension portion 56 which extends substantially perpendicular to the base 54 and thus substantially perpendicular to the channel 28, and a clip 58 which is disposed at the end of the extension portion 56 which receives the tree to be displayed. It is noted at the outset that a plurality of first securing devices such as device 50 can be positioned in the channel 28 so that the plurality of clips associated therewith extend in opposite direction from the channel 28.

With respect to the particular embodiment shown in FIG. 3, the base includes two substantially U-shaped rods 60 and 62 which have legs 64, 66, 68 and 70. Secured to legs 64 and 70 are parallel cross members 72, 74 which keep the base in the channel 28 as members 72, 74 extend underneath the lips 40, 42 of channel 28. Similar cross members are located on the other legs 68, 70 of the U-shaped rods 60, 62. Extending from and perpendicular to the U-shaped rods 60, 62 are two substantially parallel third and fourth rods 76, 78 which comprise the extension portion 56. At the end of the third and fourth rods 76, 78 is fashioned the above-indicated clip 58 which defines a capture area 80. The capture area 80 is defined by a plurality of bends which are placed in the end of the third and fourth rods 76 and 78. A ring 82 is placed at the base of the capture area to loosely secure the third and fourth rods 76, 78 together. The clip 58 includes tree guide 84, 86 which are the end portions of the rods 76, 78 which are defined in two curves to accept the trunk of the tree. The tree guides 84, 86 urge apart the portion of the rods 76, 78 which define the capture area 80, flexing these portions, and allow the tree to be captured within the capture area 80. The tree is released from the capture area by simply pulling it out past the tree guides 84, 86.

In FIG. 4, the second securing device 52 is depicted. This securing device 52 is intended for allowing trees to be positioned at the end of the stand 10. This second securing device 52 includes a base 88 which has two rods which are bent into substantially rectangular shapes 90, 92 and which are disposed substantially parallel to each other. It is to be understood that these rectangular shapes 90, 92 can, in the alternative, be U-shaped, as are rods 60 and 62 of the first securing device 50 in FIG. 3. Third and fourth rods 94 and 96 are secured to the first and second rectangles 90 and 92 in a substantially perpendicular manner thereto.

Rods 94 and 96 also comprise a portion of the base 88 along with fifth and sixth rods 98 and 100 which are disposed at an end of rods 94 and 96 which are located distally from rectangles 92 and 90 and are disposed at perpendicular angles to rods 94 and 96.

The second securing device 52 further includes an extension portion 102 and a clip 104 which are similar in design and operation to the extension portion 56 and the clip 58 of the first securing device 50 in FIG. 3. It is to be understood that the base 88 can be inserted into the end of the channel 28 (FIG. 2), with the extension portion 102 extending therefrom, and substantially parallel to the channel 28. So disposed, the second securing device 52 can allow a tree to be displayed at the end of the stand 10.

INDUSTRIAL APPLICABILITY

The operation of the stand is as follows. The length of the stand is determined, and from that determination, the number of support towers required is determined. For example, for a 32 foot stand, one embodiment would have three support towers 12, 14, 16, one on each end and one in the center. Then the support towers 12, 14, 16 are assembled in place, and the channel 28 is secured to the support towers 12, 14, 16. The bases, such as base 36 of the support tower 12, are then secured to the ground. It is to be understood that the length of the legs on these support towers is determined by the height of the trees to be displayed. Then the first securing devices 50 are inserted into the channel 28 in such a manner that alternating devices 50 point in opposite directions. The securing devices 50 are spaced along the channel in such a manner to account for the fullness of the trees being displayed.

After this occurs, the second securing devices 52, if desired, can be placed, one at each of the ends of the channel 28 to display an additional tree at each end. The second securing devices 52 can be secured in the channel by a pin (not shown) which is disposed in apertures (not shown) in the channel which is located between the rectangles 90, 92.

From the above it can be seen that the present invention solves the problems of the prior art in that it provides a stable stand for displaying trees in an organized manner, which display is unaffected by the wind and which allows a customer easy access to the trees.

Other objects and advantages of the invention can be observed from a review of the figures and the appended claims.

I claim:

1. A stand for displaying one or more objects comprising:

a first support tower;

a second support tower;

a channel;

first means for allowing the first support tower to support the channel at one location on the channel;

second means for allowing the second support tower to support the channel at another location on the channel;

means for securing an object to the stand, said securing means including a base means for holding said securing means in said channel, a clip means for allowing the object to be secured to said securing means and an extension means for connecting said base means to said clip means, said means being slidably positionable in said channel; wherein said channel has at least one lip; and said base means of said securing means include two parallel rods, each of which has been bent into substantially a U shape so as to have first and second legs, and crossbar means interconnecting the first and second legs of the rods and extending therepast, said rods and crossbars insertable into said channel under said lip and said crossbars holding said securing means in said channel.

2. The stand of claim 1 including:

a plurality of securing means which are slidably positionable in said channel.

3. The stand of claim 1 wherein:

said extension means is disposed substantially perpendicular to said channel with said base means disposed in said channel.

4. The stand of claim 3 wherein:

said clip means is disposed substantially perpendicular to said channel.

5. The stand of claim 3 including a plurality of securing means extending substantially perpendicular to said channel with said base means disposed in said channel.

6. The stand of claim 1 wherein said extension means of said securing means includes third and fourth rods extending from and perpendicular to said first and second rods.

7. The stand of claim 6 wherein said clip means of said securing means includes a capture area defined by the ends of said third and fourth rods.

8. The stand of claim 1 wherein:

said first support tower includes first and second telescoping legs secured to said first means for allowing the first support tower to support the channel.

9. The stand of claim 8 wherein the ends of said first and second telescoping legs are selectively secured to a cross member base at locations depending on the degree of telescoping of said first and second legs.

10. The stand of claim 1 including:

a plurality of securing means which are slidably positionable in said channel, at least two of said securing means extending in substantially opposite directions from each other.

11. A stand for displaying one or more objects comprising:

a first support tower;

a second support tower;

a channel;

first means for allowing the first support tower to support the channel at one location on the channel;

second means for allowing the second support tower to support the channel at another location on the channel;

means for securing an object to the stand, said securing means including a base means for holding said securing means in said channel, a clip means for allowing the object to be secured to said securing means and an extension means for connecting said base means to said clip means, said base means being slidably positionable in said channel;

wherein said extension means is disposed substantially parallel to said channel with said base means disposed in said channel;

wherein said securing means extends from the end of the channel;

wherein said channel has at least one lip;

wherein said base of said securing means includes first and second parallel rods, each of which has been bent into at least substantially a U shape and said rods insertable in said channel under said lip to hold said securing means in said channel; and wherein said base further including third and fourth rods secured to said first and second rods and disposed substantially perpendicular thereto and parallel to the channel, and fifth and sixth parallel rods secured substantially perpendicularly to the ends of the third and fourth rods at a location distal from said first and second rods.

12. The stand of claim 11 wherein:

said extension means includes seventh and eighth parallel rods secured to and substantially perpendicular to the fifth and sixth rods.

13. The stand of claim 12 wherein:

said clip means of said securing means includes a capture area defined by the ends of said seventh and eighth rods.

* * * * *